US011143133B2

(12) United States Patent
Das et al.

(10) Patent No.: US 11,143,133 B2
(45) Date of Patent: Oct. 12, 2021

(54) FUEL CONTROL SYSTEM

(71) Applicant: GE Global Sourcing LLC, Norwalk, CT (US)

(72) Inventors: Sumit Das, Bengaluru (IN); Somnath Barole, Bengaluru (IN); Vishram Nandedkar, Bengaluru (IN); Padmaprabha Subbaraj, Bengaluru (IN)

(73) Assignee: TRANSPORTATION IP HOLDINGS, LLC, Norwalk, CT (US)

( * ) Notice: Subject to any disclaimer, the term of this patent is extended or adjusted under 35 U.S.C. 154(b) by 223 days.

(21) Appl. No.: 16/437,970

(22) Filed: Jun. 11, 2019

(65) Prior Publication Data

US 2020/0392918 A1 Dec. 17, 2020

(51) Int. Cl.

| | |
|---|---|
| ***F02D 41/30*** | (2006.01) |
| ***G07C 5/08*** | (2006.01) |
| *F02D 41/22* | (2006.01) |
| *F02D 41/14* | (2006.01) |

(52) U.S. Cl.

CPC ..... *F02D 41/3005* (2013.01); *G07C 5/0816* (2013.01); *F02D 2041/1433* (2013.01); *F02D 2041/224* (2013.01); *F02D 2200/0414* (2013.01); *F02D 2200/0418* (2013.01); *F02D 2200/0614* (2013.01); *F02D 2200/0625* (2013.01); *F02D 2200/101* (2013.01)

(58) Field of Classification Search

CPC ..... F02D 41/3005; F02D 2041/1423; F02D 2041/1433–1437; F02D 2041/224; F02D 2200/0414; F02D 2200/0418; F02D 2200/0614; F02D 2200/0625; F02D 2200/101; G07C 5/0816

See application file for complete search history.

(56) References Cited

U.S. PATENT DOCUMENTS

| | | | | |
|---|---|---|---|---|
| 6,473,720 | B1 * | 10/2002 | Hampson | G05B 23/0235 702/182 |
| 6,539,783 | B1 * | 4/2003 | Adibhatla | F02C 9/00 73/112.06 |
| 7,739,004 | B2 * | 6/2010 | Johnson | F02C 9/42 701/9 |
| 2017/0159574 | A1 * | 6/2017 | Paul | F01D 21/003 |
| 2019/0032509 | A1 * | 1/2019 | Muldal | F02C 7/222 |

* cited by examiner

*Primary Examiner* — Hung Q Nguyen
*Assistant Examiner* — Mark L. Greene
(74) *Attorney, Agent, or Firm* — Christopher R. Carroll; The Small Patent Law Group LLC

(57) ABSTRACT

A fuel control system obtains a measured amount of fuel consumed by an engine and one or more corresponding operating parameters of the engine and determines a fuel consumption modeled amount based at least in part on a fuel consumption model of the engine and the one or more operating parameters. The fuel consumption model associates different amounts of fuel that, when supplied to the engine, generate corresponding designated outputs of the engine. The system also determines one or more differentials between the measured amount of fuel and the modeled amount and, responsive to the one or more of the differentials exceeding a threshold value, the system identifies one or more components of the powered system that contribute or cause the one or more differentials and/or changes an amount of fuel supplied to the engine according to the fuel consumption model to obtain a desired output of the engine.

18 Claims, 1 Drawing Sheet

FUEL CONTROL SYSTEM

FIELD

The inventive subject matter described herein relates to controlling fuel supplied to powered systems.

BACKGROUND

Powered systems having engines can change how much fuel is consumed over time. For example, conditions such as leaks in vehicle cooling systems, leaks in vehicle lubrication systems, increases in manifold air temperatures, etc., may occur. These conditions can increase the amount of fuel that is consumed by the engines. For example, these conditions can reduce the propulsion or thrust generated by engines of the vehicles and operators of the vehicles may run the vehicles in states that consume more fuel to maintain propulsion or thrust.

Monitoring fuel usage of a vehicle can indicate that a condition exists that is increasing the amount of fuel consumed by the vehicle. The amount of fuel consumed to complete a trip can be compared with prior amounts of fuel consumed to complete the same trip. Increases in fuel consumption can indicate that a condition exists that is increasing the amount of fuel consumed by the vehicle.

While the increased fuel consumption may be detected, the cause of the increased fuel consumption may not be easily or readily detected. As a result, the vehicle may continue to be operated in an increased fuel consumption mode rather than identifying the cause(s) of the increased fuel consumption.

BRIEF DESCRIPTION

In one embodiment, a method includes obtaining a measured amount of fuel consumed by an engine of a powered system and one or more corresponding operating parameters of the engine and determining a fuel consumption modeled amount based at least in part on a fuel consumption model of the engine and the one or more operating parameters of the engine. The fuel consumption model associates different amounts of fuel that, when supplied to the engine, generate corresponding designated outputs of the engine. The method also can include determining one or more differentials between the measured amount of fuel and the fuel consumption modeled amount and, responsive to the one or more of the differentials exceeding a threshold value, the method can include one or more of identifying one or more components of the powered system that contribute or cause the one or more differentials and/or changing an amount of fuel supplied to the engine according to the fuel consumption model to obtain a desired output of the engine.

In one embodiment, a system includes one or more processors configured to obtain a measured amount of fuel consumed by an engine of a powered system and one or more corresponding operating parameters of the engine. The one or more processors also are configured to determine a fuel consumption modeled amount based at least in part on a fuel consumption model of the engine and the one or more operating parameters of the engine. The fuel consumption model associates different amounts of fuel that, when supplied to the engine, generate corresponding designated outputs of the engine. The one or more processors also are configured to determine one or more differentials between the measured amount of fuel and the fuel consumption modeled amount. The one or more processors are configured to, responsive to the one or more of the differentials exceeding a threshold value, one or more of identify one or more components of the powered system that contribute or cause the one or more differentials and/or change an amount of fuel supplied to the engine according to the fuel consumption model to obtain a desired output of the engine.

In one embodiment, a system includes one or more processors configured to determine how much fuel is consumed by an engine to provide a selected engine output and while operating under an operating condition. The one or more processors also are configured to determine a modeled amount of fuel that should have been consumed by the engine to produce the selected engine output while operating under the operating condition. The one or more processors also are configured to, based on a difference between how much fuel is consumed by the engine and the modeled amount of fuel, one or more of identify a component of a powered system that includes the engine for repair and/or change how much fuel is supplied to the engine.

BRIEF DESCRIPTION OF THE DRAWINGS

Reference is now made briefly to the accompanying drawings, in which.

DETAILED DESCRIPTION

One or more embodiments of the inventive subject matter described herein relate to systems and methods that monitor fuel usage of a powered system and that determine an expected fuel consumption of the powered system based on a fuel consumption model and operating parameters of the powered system. This model can be an off-board model that identifies how much fuel should be consumed by the powered system under different operating parameters. Alternatively, this model can be an onboard model that dictates how much fuel should be supplied to the powered system for obtaining a designated output of the powered system to obtain a designated output of the powered system. For example, the model can be referred to for calculating how much fuel should be supplied to an engine so that the engine produces the horsepower associated with a manually- or autonomously-selected setting while the engine operates in conditions represented by the operating parameters.

While one or more embodiments described herein relate to a vehicle as the powered system, not all embodiments of the inventive subject matter are limited to moving vehicles. One or more embodiments may relate to control the supply of fuel to engines in stationary powered systems, such as generators or other stationary power-generating systems.

The systems can methods can determine differences between the monitored amount of fuel consumption and the modeled amount of expected fuel consumption while the vehicle is moving. In one embodiment, one or more of these differences are used to identify a condition of the vehicle that is causing the difference in fuel consumption. For example, the systems and methods can pinpoint a condition of one or more vehicle components that may be causing the vehicle to consume more or less fuel than the vehicle should be consuming. The systems and methods can implement one or more actions in response to determining the difference(s). For example, the systems and methods can automatically activate an alarm (e.g., visual, audible, and/or tactile alarm), automatically schedule repair, inspection, replacement, or other maintenance of the vehicle or one or more components of the vehicle, or perform another action. The systems and methods can restrict future operation of the vehicle (e.g., by reducing an upper limit on the throttle settings of the engine).

The systems and methods optionally can change the model to account for the differences. For example, the condition of the vehicle may result in a greater amount of fuel to be supplied to the engine under operating parameters than indicated by the model. The systems and methods can change the model so that, given the same operating parameters, the modified model indicates that more fuel is to be supplied to the engine to obtain a desired output than the model prior to modification. This modification can be a temporary change to the model.

Figure 1:
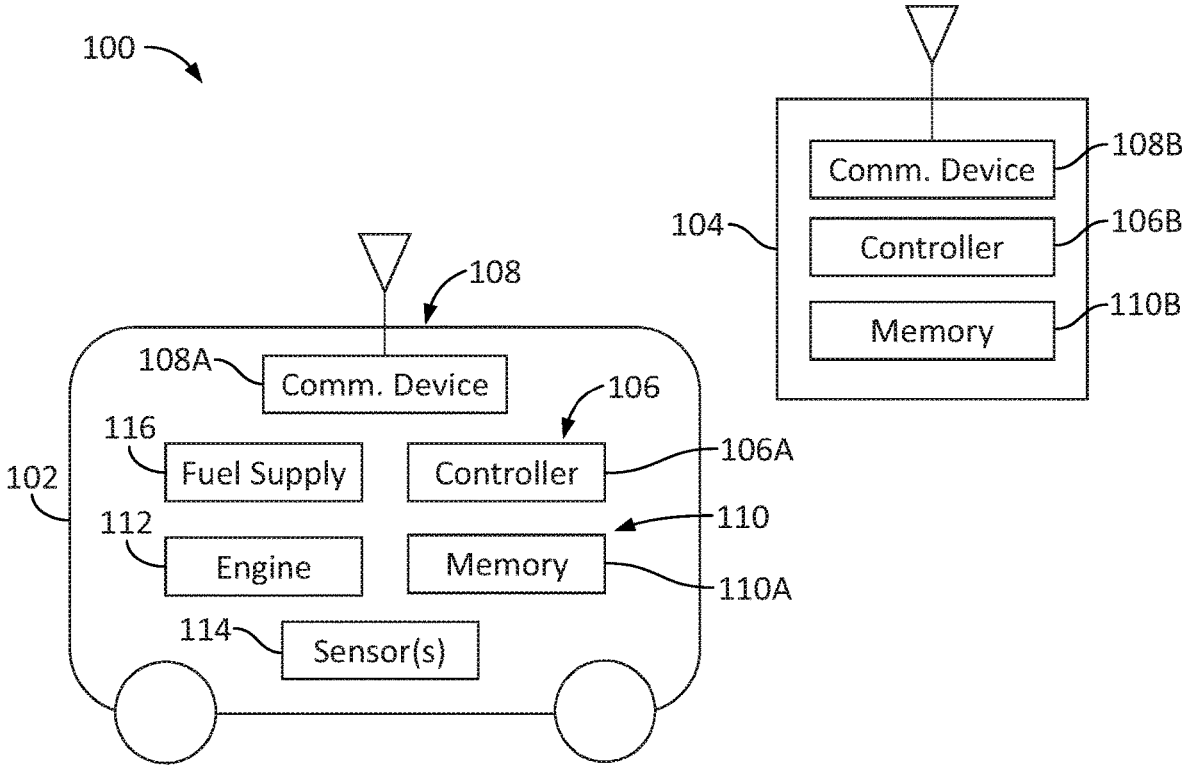
FIG. 1 illustrates one embodiment of a vehicle fuel control system.

FIG. 1 illustrates one embodiment of a vehicle fuel control system 100. The control system may be partially disposed onboard one or more vehicles 102 and an off-board monitoring facility 104, entirely onboard a vehicle, or entirely in the facility. The vehicle can represent an automobile, a rail vehicle (e.g., a locomotive), a mining vehicle, a marine vessel, an aircraft (e.g., an unmanned aerial vehicle or a manned aircraft), a construction vehicle or equipment, an agricultural vehicle or equipment, or another off-highway vehicle (e.g., a vehicle that is not designed and/or is not legally permitted for travel on public roadways). The facility can represent a building, wayside device, or other structure, in which various components of the control system may be located.

The control system includes one or more controllers 106 (e.g., controllers 106A, 106B) that represent hardware circuitry connected with and/or including one or more processors (e.g., microprocessors, field programmable gate arrays, integrated circuits, etc.) that perform the operations associated with the controller(s). A controller is shown onboard the vehicle and in the facility—the description of the controller herein can apply to either or both these controllers. Communication devices 108 (e.g., communication devices 108A, 108B) represent transceiving circuitry that communicates with other communication devices. This circuitry can include modems, antennas, and the like, for wirelessly communicating between the vehicles, between the vehicle(s) and the facility, etc. Memories 110 (e.g., memories 110A, 110B) represent tangible and non-transitory computer-readable storage media, such as computer hard drives, removable computer drives, optical disks, USB memories, etc. The models described herein can be stored on one or more of the memories and/or communicated between the vehicles and/or facility via the communication devices.

With respect to the vehicle, an engine 112 receives fuel from a fuel supply 116. The engine can consume fuel to generate outputs, such as horsepower, that propels the vehicle. The fuel supply represents one or more devices that control the delivery of fuel to the engine, such as fuel injectors fluidly coupled with a fuel tank by conduits. The controller of the vehicle can control operation of the fuel injectors to vary how much fuel is supplied to the engine (e.g., such as to individual cylinders of the engine) to control how much output is generated by the engine.

Figure 2:
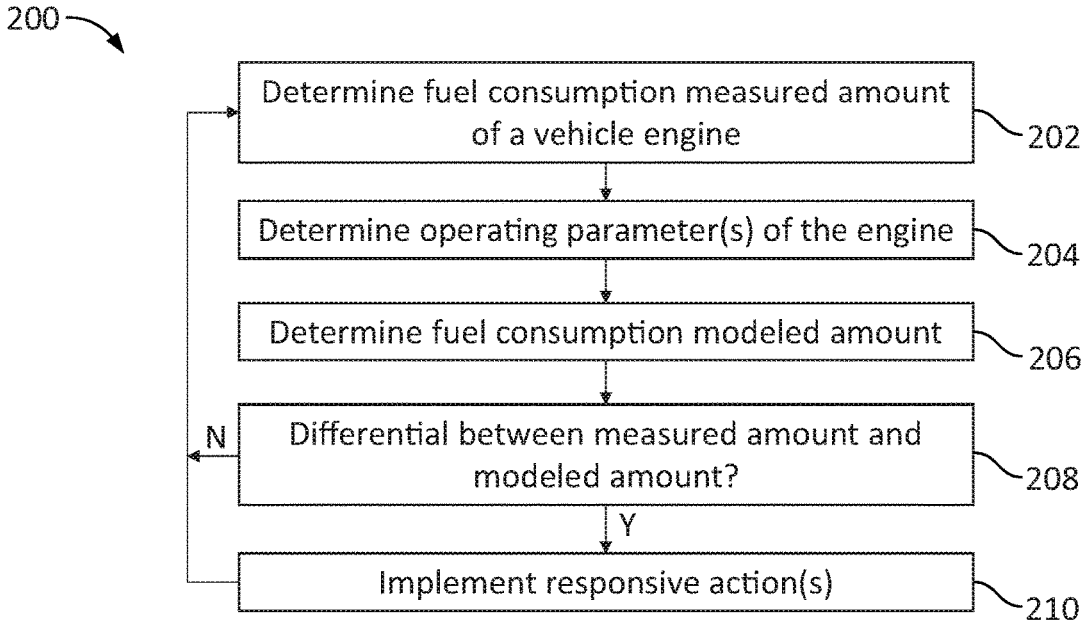
FIG. 2 illustrates a flowchart of one embodiment of a method for controlling the supply of fuel to a vehicle.

With continued reference to the fuel control system shown in FIG. 1, FIG. 2 illustrates a flowchart of one embodiment of a method 200 for controlling the supply of fuel to a vehicle. The method can represent operations performed by the control system. At 202, fuel consumption of the vehicle engine is determined. This fuel consumption can be determined while the vehicle is moving. For example, the fuel consumption can be an instantaneous fuel consumption, which means the amount (e.g., volume, mass, etc.) of fuel that is supplied to the engine during the time period (e.g., a particular instant in time) that is substantially shorter than an entire trip of the vehicle. This time period, particular data snapshot, or data point time period may be less than one second and could be burst of data points. The fuel consumption can be determined by measuring the volume, mass, flow rate, or the like, at which fuel is supplied to one or more, or all, engine cylinders through fuel injectors Alternatively, the fuel consumption can be measured by one or more sensors 114, such as flow rate sensors.

At 204, one or more operating parameters of the engine are determined. The operating parameters indicate one or more settings of the engine and/or vehicle and can represent one or more conditions in which the engine is operating. The controller can determine the operating parameters based on data output by the sensors and/or input provided by an operator of the vehicle. An operating parameter can be a desired output of the engine, which can be determined by or represented by a throttle setting of the engine, a desired or selected horsepower to be obtained from the engine, etc.

Another operating parameter can be a speed at which the engine is operating. The operating parameters can include a temperature of air or other fluids flowing in a manifold of the engine (e.g., a manifold air temperature) as measured by the sensors (e.g., a temperature sensor). The operating parameters can include an air-to-fuel ratio that is supplied to one or more cylinders of the engine (as measured by how long a fuel injector is open to deliver fuel to a cylinder and a sensor that measures air flow rate to the cylinder). The operating parameters can include pressure of coolant and/or lubricant (oil) in a cooling system or lubrication system of the vehicle (and as measured by pressure sensors). The operating parameters optionally can include ambient conditions, such as an ambient temperature, ambient pressure, humidity, etc., as measured by the sensors.

At 206, a fuel consumption modeled amount is determined. The fuel consumption modeled amount is an amount of fuel that is expected to be supplied to the engine to obtain the desired output of the engine. This modeled amount is determined from one or more mathematical models of the engine that are stored in one or more of the memories. The model can associate different combinations of operating parameters with different modeled amounts of fuel consumption. For example, the model can be or represent one or more mathematical relationships between expected amounts of fuel consumption and different combinations of operating parameters and/or desired engine outputs. In one embodiment, the desired engine output and operating parameter(s) are input into the controller and the controller, using the model, calculates the expected fuel consumption. Alternatively, the model can be a list or table of different expected amounts of fuel consumption and different combinations of operating parameters and/or desired engine outputs. The controller can refer to the list or table to determine how much fuel is expected to be consumed.

For example, the model can indicate that a first amount of fuel should be consumed (e.g., is expected to be consumed) to obtain a desired engine output when the engine is operating under one or more (or all) of the following conditions: a first throttle setting, a first engine speed, a first manifold air temperature, a first air-to-fuel ratio, a first coolant pressure, a first oil pressure, a first ambient temperature, a first ambient pressure, and/or a first humidity. But, the model also can indicate that a different, second amount of fuel should be consumed (e.g., is expected to be consumed) to obtain the same desired engine output when the engine is operating under one or more different conditions (e.g., a different, second throttle setting, a different, second engine speed, a different, second manifold air temperature, a different, second air-to-fuel ratio, a different, second coolant pressure, a different, second oil pressure, a different, second ambient temperature, a different, second ambient pressure, and/or a different, second humidity). The model can indicate that a different, third amount of fuel should be consumed to obtain a different desired engine output when the engine is operating under the same operating conditions.

The model can be determined from prior measurements of fuel consumption of the vehicle or one or more other vehicles. For example, empirical data of how much fuel the same vehicle or another vehicle consumed while operating under various combinations of operating conditions to obtain various engine outputs may be measured from prior trips of the vehicle or other vehicles. With respect to other vehicles, this data can be collected for other vehicles in the same fleet and used to model the fuel consumption across many or all vehicles in the fleet.

At 208, a determination is made as to whether the fuel consumption modeled amount differs from the fuel consumption measured amount. For example, the controller can determine that the engine consumed more fuel than expected to provide the desired output based on the model and the operating parameters. Alternatively, the controller can determine that the engine consumed less fuel than expected to provide the desired output based on the model and the operating parameters.

If the controller identifies such a difference, the difference can indicate that a condition of one or more components of the vehicle may be causing the engine to consume more or less fuel than expected. For example, a leak in one or more seals of the vehicle, an improperly assembled system of the vehicle, a broken or worn fan of the vehicle, etc., may be causing the engine to demand (and consume) more fuel than expected to produce the desired output. The difference can be detected by the controller responsive to the measured amount of fuel consumed exceeding or falling below the modeled amount of fuel consumed by any amount or by at least a threshold amount (e.g., at least 3% of the modeled amount, at least 5% of the modeled amount, or at least 10% of the modeled amount in some different examples of the systems and methods described herein). Optionally, the difference can be detected responsive to the difference being greater than a threshold amount.

In one example, the controller can determine whether any differential (between modeled and measured fuel consumption) exists in real time. For example, the controller can compare the modeled and measured amounts as the vehicle moves (and not after a trip of the vehicle is completed). The controller can detect the differences each time fuel is delivered to the engine, repeatedly but not each time fuel is delivered to the engine, at periodic or repeating times, at repeated but not periodic times (e.g., irregular or aperiodic times), or the like. Alternatively, the controller can determine whether any differential exists not in real time, but after completion of a trip of the vehicle is completed.

If a differential is identified, flow of the method can proceed toward 210 for one or more responsive actions to be implemented. These responsive actions can be implemented to change or transform a state or mode of the vehicle. Alternatively, if a differential is not identified, then flow of the method can return toward 202 to continue monitoring fuel consumption versus the modeled amount of fuel consumption. In another embodiment, flow of the method can terminate.

At 210, one or more actions are implemented in response to detecting the differential between modeled and measured fuel consumption. In one example, the controller can identify one or more components of the vehicle that cause the fuel differential that is identified. The controller can examine the operating parameter(s) to pinpoint which vehicle component is in a condition that is causing the fuel consumed to increase above the modeled fuel consumption.

The memory can store data representative of relationships between operating parameters and vehicle components that are used by the controller to pinpoint which vehicle component may be causing the fuel consumption differential. These relationships can be modeled or measured from previous trips of the vehicle or other vehicles (e.g., in the same fleet). For example, different modeled amounts of fuel consumption can be associated (e.g., in the memory) with different designated operating parameters or combinations of designated operating parameters. If these designated operating parameters differ from the operating parameters detected in association with a measured fuel consumption (that differs from the modeled fuel consumption), then the controller can identify which component of the vehicle may be causing the fuel differential based on the operating parameter difference.

As one example, the controller can determine that a fuel injector, solenoid, pump, or switch of the fuel supply system needs inspection, repair, or replacement responsive to the fuel differential indicating that more fuel is being consumed that the modeled amount. The controller can determine that the fuel injector, solenoid, switch, or pump is remaining open or activated too long due to the measured amount of fuel consumed exceeding the modeled amount of fuel consumed. Or, the controller can determine that the fuel injector, solenoid, switch, or pump is worn or remaining closed due to the measured amount of fuel consumed being less than the modeled amount of fuel consumed.

The controller can determine that a lubrication system of the vehicle is leaking, a cooling system of the vehicle is leaking, a power assembly or powertrain of the vehicle is faulty, and/or the fuel supply system of the vehicle is leaking (and causing or impacting fuel consumption) responsive to (a) a fuel differential being detected, (b) the engine speed being faster than the engine speed associated with the modeled amount of fuel consumption, (c) the air temperature in the engine manifold being within a designated range (e.g., within 3%, within 5%, within 10%, or within 20% according to different embodiments) of a manifold air temperature associated with the modeled amount of fuel consumption, and (d) the air-to-fuel ratio of the engine being smaller than a designated air-to-fuel ratio associated with the modeled amount of fuel consumption. As another example, the controller can determine that an air delivery system (e.g., that directs air into the engine and/or a cooling system) of the vehicle is leaking (and causing or impacting fuel consumption) responsive to the fuel differential being detected, the engine speed being within a designated range of the designated engine speed associated with the modeled amount of fuel consumption, the air temperature in the engine manifold being greater than the designated manifold air temperature associated with the modeled amount of fuel consumption, and the air-to-fuel ratio of the engine being smaller than the designated air-to-fuel ratio associated with the modeled amount of fuel consumption.

In yet another example, the controller can determine that the cooling system of the vehicle is faulty (e.g., a fan or blower is not generating enough airflow to cool components of the vehicle) and causing or impacting fuel consumption responsive to the fuel differential being detected, the air temperature in the engine manifold being greater than the designated manifold air temperature associated with the modeled amount of fuel consumption, the air-to-fuel ratio of the engine being greater than the designated air-to-fuel ratio associated with the modeled amount of fuel consumption, and the fuel pressure of the fuel supply system being within a designated range of a designated fuel pressure associated with the modeled amount of fuel consumption. As another example, the controller can determine that the fuel supply system of the vehicle is faulty and causing or impacting fuel consumption responsive to the fuel differential being detected, the air temperature in the engine manifold being greater than the designated manifold air temperature associated with the modeled amount of fuel consumption, and the fuel pressure of the fuel supply system being greater than the designated fuel pressure associated with the modeled amount of fuel consumption.

Responsive to identifying the component(s), the controller can automatically generate a warning to an operator of the vehicle (e.g., a visible light or display, a sound, etc.) and/or automatically send a signal via the communication device to the facility or another location. The warning can instruct the operator to check on the condition of the component that is identified. For example, the warning can instruct the operator to check for a lubricant or coolant leak. The signal can request the repair, inspection, or replacement of the identified component (e.g., once the vehicle arrives at the facility or location).

Optionally, the controller can automatically restrict operation of the vehicle. For example, the controller can place an upper limit on throttle settings, engine speeds, or the like, that is lower than a maximum throttle setting, engine speed, etc. This upper limit can prevent the vehicle operator from causing the vehicle from operating at throttle settings, engine speeds, etc. that exceed the upper limit (and potentially damage the identified or other vehicle components). This also can reduce an operating temperature of the vehicle (e.g., a manifold air temperature) that was detected. The controller optionally can automatically control the vehicle to limp home, such as by causing the vehicle to move to a repair location at a reduced throttle setting.

The controller may use the identified fuel differential to change how much fuel is subsequently supplied to the engine. The engine may not provide the desired output when operating in the detected operating parameters and when supplied with the modeled amount of fuel (for the desired output and detected operating parameters). Instead, the engine may produce a lesser output. For example, instead of providing a desired horsepower given current operating parameters and a modeled amount of fuel, the engine may provide a lesser amount of horsepower. The controller can detect and respond to such an output differential of the engine by changing how much fuel is supplied to the engine. The controller can receive a request for an engine output from an operator of the vehicle (or from a plan that is used for automatic control of the vehicle) after previously identifying the fuel differential. The controller can refer to the fuel consumption model and determine the modeled amount of fuel to supply to the engine based on the operating parameters and requested engine output, as described above. Instead of controlling the fuel supply system to provide the engine with the modeled amount of fuel, however, the controller can use the previously identified fuel differential and direct the fuel supply system to provide more fuel to the engine (more than the modeled amount of fuel). This additional fuel can be referred to as a fuel boost above the modeled amount of fuel. This can ensure that the engine provides the requested engine output, even when one or more components of the vehicle are causing the engine to consume a different amount of fuel (than the modeled amount). The amount of the fuel boost can be based on previously identified fuel differentials. For example, the fuel boost can be equal to or proportional to one or more of the previously identified fuel differentials.

Over time, the controller may adjust the model. The model may be adjusted due to aging and/or usage of vehicle components. For example, as the components age and/or are used more, the modeled amounts of fuel consumed may change (for the same operating parameters). The model can be modified to account for the components not operating as efficiently as before when the components were newer and/or less worn.

The controller can change the modeled fuel amounts based on one or more fuel differentials. For example, as the controller identifies more and more fuel differentials, the controller can change the model to reduce or eliminate future fuel differentials from being identified. This can allow for the model to be updated to account for aging of the vehicle and/or vehicle components. Larger fuel differentials may still be used to pinpoint vehicle components needing repair, inspection, or replacement, but the model can be updated to ensure that components are not falsely identified as having failed.

In one embodiment, the model for one vehicle can be modified based on performance metrics of other vehicles. For example, the vehicle may be part of a fleet of vehicles of the same model, made by the same manufacturer, etc. Fuel differentials identified within this fleet of vehicles may be performance metrics that are used to modify the model of other vehicles, even if the other vehicles are not yet exhibiting the fuel differentials. The outputs of the engines of these vehicles in the fleet also may be performance metrics that are used to modify the model for the vehicle.

Subsequent to one or more components of the vehicle being identified as being in a condition causing the fuel differential to exist, the controller may automatically control operation of the vehicle to determine whether the condition has changed. For example, after identifying a fuel differential, one or more components identified using the fuel differential can be repaired, replaced, or otherwise maintained. The controller can then automatically control the vehicle to operate according to a prescribed set of the operating parameters. These operating parameters can be the same as or otherwise based on the operating parameters associated with the fuel differential. For example, the controller can automatically control the vehicle to mimic the conditions in which the fuel differential was identified. This can occur within a repair facility (e.g., a shop), while the vehicle is moving, or in another location. The controller can again determine whether there is a fuel differential. If the differential is identified, then the controller can optionally warn an operator and can determine whether the same or other components may be at fault for causing the fuel differential. This process can ensure that all components associated with causing the fuel differential are identified. For example, the impact of one component on the fuel differential may mask or otherwise hide the impact of another component. By mimicking the conditions in which the fuel differential was first identified, the controller can determine if other components are also contributing to causing the fuel differential.

As another example of a responsive action, the controller can change a route being traveled by the vehicle. Responsive to detecting a fuel differential and the operating parameters associated with the fuel differential, the controller can change where the vehicle is traveling to change or reduce the operating parameters. For example, the manifold air temperature associated with a fuel differential may be hotter than a designated temperature. The controller can automatically control the vehicle (or direct an operator) to move the vehicle to an area where the ambient temperature is cooler. As another example, the manifold air temperature associated with a fuel differential may be cooler than a designated temperature. The controller can automatically control the vehicle (or direct an operator) to move the vehicle to an area where the ambient temperature is warmer. As another example, the air-to-fuel ratio associated with a fuel differential may be smaller than a designated temperature. The controller can automatically control the vehicle (or direct an operator) to move the vehicle to an area where there is more oxygen (e.g., outside of an airflow restricted area such as a tunnel, valley, or urban area). The controller can control movement of the vehicle by controlling a steering mechanism of the vehicle, by sending a signal to a wayside device (e.g., a gate, a switch at an intersection of routes, etc.) to cause the device to change which route is traveled by the vehicle.

In one embodiment, a method includes obtaining a measured amount of fuel consumed by an engine of a powered system and one or more corresponding operating parameters of the engine and determining a fuel consumption modeled amount based at least in part on a fuel consumption model of the engine and the one or more operating parameters of the engine. The fuel consumption model associates different amounts of fuel that, when supplied to the engine, generate corresponding designated outputs of the engine. The method also can include determining one or more differentials between the measured amount of fuel and the fuel consumption modeled amount and, responsive to the one or more of the differentials exceeding a threshold value, the method can include one or more of: identifying one or more components of the powered system that contribute or cause the one or more differentials and/or changing an amount of fuel supplied to the engine according to the fuel consumption model to obtain a desired output of the engine.

Optionally, the method includes identifying the one or more components for one or more of repair, inspection, or replacement based on the one or more differentials and one or more of the operating parameters.

Optionally, the method also can include modifying the fuel consumption model based at least in part on one or more of age engine, age of a fuel supply system of the powered system, or usage of the engine.

Optionally, the powered system is a vehicle and the method also can include modifying the fuel consumption model based at least in part on performance metrics of a fleet of vehicles that include a vehicle housing the engine.

Optionally, the method also can include, responsive to the one or more differentials exceeding a corresponding designated threshold value, directing the engine to operate according to a prescribed set of the operating parameters to replicate the operating parameters that were used when the measured amount of fuel consumed differed from the fuel consumption modeled amount, determining additional fuel consumption by the engine while operating according to the prescribed set of the operating parameters, and determining whether a differential between the additional fuel consumption and the fuel consumption modeled amount exceeds the threshold value.

Optionally, the method also can include generating a notification signal responsive to the one or more differentials exceeding the threshold value.

Optionally, the method also can include scheduling one or more of repair, maintenance, or inspection of the engine responsive to the one or more differentials exceeding the threshold value.

Optionally, the method also can include one or more of scheduling for movement or moving a vehicle that includes the engine to a designated location responsive to the one or more differentials exceeding the threshold value.

Optionally, the method also can include changing an operation in addition to changing how much fuel is supplied to the engine in response to determining that one or more of the differential exceeds the threshold value.

Optionally, the powered system is an automobile, a marine vessel, a rail vehicle, mining equipment, construction equipment, agricultural equipment, or an aircraft.

In one embodiment, a system includes one or more processors configured to obtain a measured amount of fuel consumed by an engine of a powered system and one or more corresponding operating parameters of the engine. The one or more processors also are configured to determine a fuel consumption modeled amount based at least in part on a fuel consumption model of the engine and the one or more operating parameters of the engine. The fuel consumption model associates different amounts of fuel that, when supplied to the engine, generate corresponding designated outputs of the engine. The one or more processors also are configured to determine one or more differentials between the measured amount of fuel and the fuel consumption modeled amount. The one or more processors are configured to, responsive to the one or more of the differentials exceeding a threshold value, one or more of identify one or more components of the powered system that contribute or cause the one or more differentials and/or change an amount of fuel supplied to the engine according to the fuel consumption model to obtain a desired output of the engine.

Optionally, the one or more processors also are configured to identify the one or more components for one or more of repair, inspection, or replacement based on the one or more differentials and one or more of the operating parameters.

Optionally, the one or more processors are configured to modify the fuel consumption model based at least in part on one or more of age engine, age of a fuel supply system of the powered system, or usage of the engine.

Optionally, the powered system is a vehicle and the one or more processors are configured to modify the fuel consumption model based at least in part on performance metrics of a fleet of vehicles that include a vehicle housing the engine.

Optionally, the one or more processors are configured to, responsive to the one or more differentials exceeding a corresponding designated threshold value, direct the engine to operate according to a prescribed set of the operating parameters to replicate the operating parameters that were used when the measured amount of fuel consumed differed from the fuel consumption modeled amount, determine additional fuel consumption by the engine while operating according to the prescribed set of the operating parameters, and determine whether a differential between the additional fuel consumption and the fuel consumption modeled amount exceeds the threshold value.

In one embodiment, a system includes one or more processors configured to determine how much fuel is consumed by an engine to provide a selected engine output and while operating under an operating condition. The one or more processors also are configured to determine a modeled amount of fuel that should have been consumed by the engine to produce the selected engine output while operating under the operating condition. The one or more processors also are configured to, based on a difference between how much fuel is consumed by the engine and the modeled amount of fuel, one or more of identify a component of a powered system that includes the engine for repair and/or change how much fuel is supplied to the engine.

Optionally, the one or more processors also are configured to change an operation of the powered system in addition to changing how much fuel is supplied to the engine based on the difference between how much fuel is consumed and the modeled amount of fuel.

Optionally, the operation that is changed includes reducing an operating temperature of the powered system that includes the engine.

Optionally, the operation that is changed includes changing a route being traveled by a vehicle that includes the engine.

Optionally, the operation that is changed includes changing a state of a switch at an intersection between routes so that a vehicle that includes the engine moves from a first route to a second route.

This written description uses examples to disclose several embodiments of the inventive subject matter and also to enable one of ordinary skill in the art to practice the embodiments of inventive subject matter, including making and using any devices or systems and performing any incorporated methods. The patentable scope of the inventive subject matter is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

The foregoing description of certain embodiments of the present inventive subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, processors or memories) may be implemented in a single piece of hardware (for example, a general purpose signal processor, microcontroller, random access memory, hard disk, and the like). Similarly, the programs may be stand-alone programs, may be incorporated as subroutines in an operating system, may be functions in an installed software package, and the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" of the present inventive subject matter are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the subject matter set forth herein without departing from its scope. While the dimensions and types of materials described herein are intended to define the parameters of the disclosed subject matter, they are by no means limiting and are exemplary embodiments. Many other embodiments will be apparent to those of skill in the art upon reviewing the above description. The scope of the subject matter described herein should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A method comprising:

obtaining a measured amount of fuel consumed by an engine of a powered system and one or more corresponding operating parameters of the engine;

determining a fuel consumption modeled amount based at least in part on a fuel consumption model of the engine and the one or more operating parameters of the engine, the fuel consumption model associating different amounts of fuel that, when supplied to the engine, generate corresponding designated outputs of the engine;

determining one or more differentials between the measured amount of fuel that is consumed by the engine and the fuel consumption modeled amount; and responsive to the one or more of the differentials exceeding one or more threshold values, changing an amount of fuel supplied to the engine according to the fuel consumption model to obtain a desired output of the engine and changing an operation in addition to changing the amount of fuel supplied to the engine.

2. The method of claim 1, wherein the method also includes identifying one or more components for one or more of repair, inspection, or replacement based on the one or more differentials and one or more of the operating parameters.

3. The method of claim 1, further comprising:

modifying the fuel consumption model based at least in part on one or more of age of the engine, age of a fuel supply system of the powered system, or usage of the engine.

4. The method of claim 1, wherein the powered system is a vehicle, and further comprising:

modifying the fuel consumption model based at least in part on performance metrics of a fleet of vehicles that includes the vehicle having the engine.

5. The method of claim 1, further comprising, responsive to the one or more differentials exceeding a corresponding designated threshold value of the one or more threshold values:

directing the engine to operate according to a prescribed set of the operating parameters to replicate the operating parameters that were used when the measured amount of fuel consumed differed from the fuel consumption modeled amount;

determining additional fuel consumption by the engine while operating according to the prescribed set of the operating parameters; and determining whether a differential between the additional fuel consumption and the fuel consumption modeled amount exceeds the corresponding designated threshold value.

6. The method of claim 1, further comprising generating a notification signal responsive to the one or more differentials exceeding the one or more threshold values.

7. The method of claim 6, further comprising scheduling one or more of repair, maintenance, or inspection of the engine responsive to the one or more differentials exceeding the one or more threshold values.

8. The method of claim 1, further comprising one or more of scheduling for movement or moving a vehicle that includes the engine to a designated location responsive to the one or more differentials exceeding the one or more threshold values.

9. The method of claim 1, wherein the powered system is an automobile, a marine vessel, a rail vehicle, mining equipment, construction equipment, agricultural equipment, or an aircraft.

10. A system comprising:

one or more processors configured to obtain a measured amount of fuel consumed by an engine of a powered system and one or more corresponding operating parameters of the engine, the one or more processors also configured to determine a fuel consumption modeled amount based at least in part on a fuel consumption model of the engine and the one or more operating parameters of the engine, the fuel consumption model associating different amounts of fuel that, when supplied to the engine, generate corresponding designated outputs of the engine, the one or more processors also configured to determine one or more differentials between the measured amount of fuel that is consumed by the engine and the fuel consumption modeled amount, the one or more processors also configured to, responsive to the one or more of the differentials exceeding one or more threshold values, perform one or more of:

identifying of one or more components of the powered system that contribute or cause the one or more differentials, or changing an amount of fuel supplied to the engine according to the fuel consumption model to obtain a desired output of the engine, wherein the powered system is a vehicle and the one or more processors are configured to modify the fuel consumption model based at least in part on performance metrics of a fleet of vehicles that includes the vehicle having the engine.

11. The system of claim 10, wherein the one or more processors also are configured to identify the one or more components for one or more of repair, inspection, or replacement based on the one or more differentials and one or more of the operating parameters.

12. The system of claim 10, wherein the one or more processors are configured to modify the fuel consumption model based at least in part on one or more of age of the engine, age of a fuel supply system of the powered system, or usage of the engine.

13. The system of claim 10, wherein the one or more processors are configured to, responsive to the one or more differentials exceeding a corresponding designated threshold value of the one or more threshold values, direct the engine to operate according to a prescribed set of the operating parameters to replicate the operating parameters that were used when the measured amount of fuel consumed differed from the fuel consumption modeled amount, determine additional fuel consumption by the engine while operating according to the prescribed set of the operating parameters, and determine whether a differential between the additional fuel consumption and the fuel consumption modeled amount exceeds the corresponding designated threshold value.

14. A system comprising:

one or more processors configured to determine how much fuel is consumed by an engine to provide a selected engine output and while operating under an operating condition, the one or more processors also configured to determine a modeled amount of fuel that should have been consumed by the engine to produce the selected engine output while operating under the operating condition, the one or more processors also configured to, based on a difference between how much fuel is consumed by the engine and the modeled amount of fuel, generate a control signal to control the engine or another component of the system, wherein the control signal is configured to change how much fuel is supplied to the engine, and the one or more processors also are configured to change an operation of a powered system that includes the engine in addition to changing how much fuel is supplied to the engine based on the difference between how much fuel is consumed and the modeled amount of fuel.

15. The system of claim 14, wherein the control signal one or more of: identifies a component of the powered system that includes the engine for repair or changes how much fuel is supplied to the engine.

16. The system of claim 14, wherein the operation that is changed includes reducing an operating temperature of the powered system that includes the engine.

17. The system of claim 14, wherein the operation that is changed includes changing a route being traveled by a vehicle that includes the engine.

18. The system of claim 14, wherein the operation that is changed includes changing a state of a switch at an intersection between routes so that a vehicle that includes the engine moves from a first route to a second route.

* * * * *